United States Patent [19]

John

[11] Patent Number: 5,044,277

[45] Date of Patent: Sep. 3, 1991

[54] FLUID APPLICATION SYSTEM FOR A PRINTING MACHINE CYLINDER, ESPECIALLY CHAMBERED DOCTOR BLADE INKER

[75] Inventor: Thomas John, Augsburg, Fed. Rep. of Germany

[73] Assignee: Man Roland Druckmaschinen AG, Offenbach am Main, Fed. Rep. of Germany

[21] Appl. No.: 492,539

[22] Filed: Mar. 12, 1990

[30] Foreign Application Priority Data

Mar. 25, 1989 [DE] Fed. Rep. of Germany ..... 3909878

[51] Int. Cl.[5] ..... B41F 31/02

[52] U.S. Cl. ..... 101/367; 101/148; 101/210; 101/363

[58] Field of Search ..... 101/364, 350, 366, 363, 101/148, 157, 207, 208, 210, 147, 365, 367; 118/261

[56] References Cited

U.S. PATENT DOCUMENTS

| | | | |
|---|---|---|---|
| 4,051,782 | 10/1977 | Fernandez | 101/365 |
| 4,058,058 | 11/1977 | Hantscho | 101/365 |
| 4,222,328 | 9/1980 | Doyle | 101/366 |
| 4,263,848 | 4/1981 | Matalia et al. | 101/350 |
| 4,284,005 | 8/1981 | Weigele et al. | 101/366 X |
| 4,559,871 | 12/1985 | Kutzner et al. | 101/366 |
| 4,682,542 | 7/1987 | Wieland | 101/364 |
| 4,688,482 | 8/1987 | Tobias | 101/350 |
| 4,819,558 | 4/1989 | Counard | 101/350 |

FOREIGN PATENT DOCUMENTS 3408183 3/1985 Fed. Rep. of Germany .

*Primary Examiner*—Edgar S. Burr
*Assistant Examiner*—Christopher Bennett
*Attorney, Agent, or Firm*—Frishauf, Holtz, Goodman & Woodward

[57] ABSTRACT

To prevent escape of ink from a gap (A) between the edge surface (11) of a side wall portion (10) facing a printing machine roller (9) and the surface of the roller, the side wall (3), or at least the side wall portion, is upwardly, outwardly inclined, so that internal flow of printing ink within the chamber, upon rotation of the roller, will result in a resultant flow speed vector ($V_{res}$) which is inclined at an angle ($\beta$) which is less than the angle of inclination ($\alpha$) of the side wall, and thereby push liquid away from the side wall and hence from said gap (A).

3 Claims, 1 Drawing Sheet a
A
B
C
2
3
4
5
6
7
8
9
11

2
4
5
6
7
8
10
11
12
III
B
C
α

$P_0$
$P_1$
$V_t$
$V_a$
$V_{res}$
11
α
β

FLUID APPLICATION SYSTEM FOR A PRINTING MACHINE CYLINDER, ESPECIALLY CHAMBERED DOCTOR BLADE INKER

Reference to related application, the disclosure of which is hereby incorporated by reference, assigned to the assignee of the present invention:

U.S. Ser. No. 07/492,538, filed Mar. 12, 1990, JOHN

Reference to related patent: U.S. Pat. No. 4,584,941, Weber (to which German 34 08 183 corresponds).

FIELD OF THE INVENTION

The present invention relates to a system to apply a fluid, and more particularly printing ink, to a cylinder or roller of a printing machine, for example an anilox roller, using a chambered doctor blade unit,

BACKGROUND

Chambered doctor blade units for inkers for printing machines are well known; customarily, they include an essentially open box-like structure forming a bottom wall, a top wall, a rear wall, and side walls. Doctor blades, scrapers, or stripping elements are set in or attached to the top and bottom walls, or the doctor blade units themselves are made with surfaces functioning as stripping elements, positioned for engagement with, or closely adjacent the printing machine roller, for example and anilox roller, with which they are to cooperate. The side walls, directly or by way of inserts, have a curved surface which extends towards the printing machine roller, with a radius of curvature corresponding generally to that of the cooperating roller. It has been customary to construct the side walls of such inkers parallel to each other, and perpendicular to the axis of rotation of the roller with which they are to cooperate. It has been found that overpressure of ink between the roller of the printing machine and the associated end surfaces of the side walls has the tendency to squeeze or press ink outside of the side walls. This is particularly apparent in inkers in which the side walls do not have an elastic sealing strip or any sealing arrangement to seal the side walls against the printing machine roller has been worn; some doctor blade units also use side walls which have a slight clearance from the inker roller.

THE INVENTION

It is an object to provide an inker unit of the chambered type in which the side walls are so constructed that escape of ink from the unit is effectively eliminated or, at least, substantially reduced with respect to prior art structures.

Briefly, at least a portion of the side walls which is adjacent to and faces the roller or cylinder of the printing machine is outwardly inclined, with respect to a plane perpendicular to the axis of rotation of the roller, in such a manner that, starting from a region of run-on of the roller, considered in the roller's direction of rotation, towards the run-off region, the inclination is outwardly.

In accordance with a preferred form of the invention, the angle of inclination is matched to the speed of rotation of the printing machine roller, typically an anilox roller, to result in pressure relationships within the chambered inker unit, or ink circulation therein away from the region of the side walls where the ink could escape laterally outside in a gap between the roller and the side walls.

DRAWINGS

DETAILED DESCRIPTION.

Figure 1:
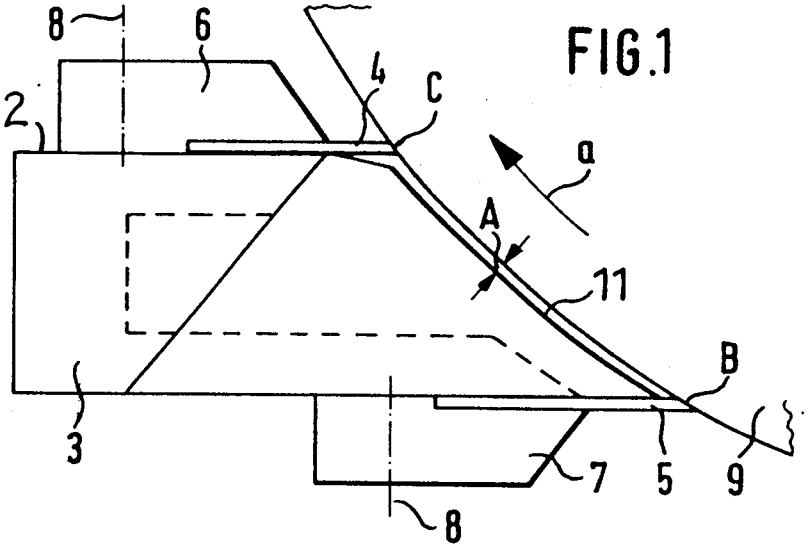
FIG. 1 is a highly schematic side view of an inker using a chambered inker structure.
Figure 2:
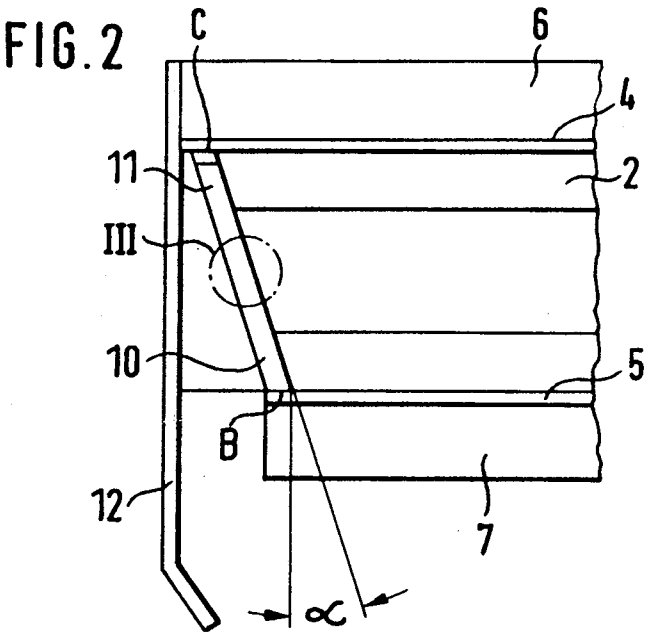
FIG. 2 is a fragmentary view showing just one side wall, from the front, of the inker of FIG. 1.

A chambered inker structure 1, see FIG. 1, has a generally U-shaped base body 2, closed off at the lateral ends by side walls 3. Two doctor blades 4, 5 project from the chambered doctor blade unit. The doctor blades 4, 5 are held in position by clamping jaws 6, 7, secured by screws 8, shown only schematically. Other arrangements may be used, for example the doctor blades can be set into the top and bottom walls of the base body, or the base body may be made of a wear-resistant material, for example metal or a hard plastic, and extend forward towards the surface of a printing machine inker roller 9.

The chambered unit 1 can be placed against the inker roller 9, typically an anilox roller, so that the doctor blades 4, 5 or their equivalents are in effective engagement with the roller 9. In operation, the roller 9 rotates in the direction of the arrow a. The doctor blade 4 strips excess ink off the roller 9; the doctor blade 5 closes off the inker chamber towards the bottom. Each one of the side walls 3 is formed with a region 10 of reduced wall thickness. The region 10 terminates in an end surface 11 which is curved with a radius of curvature corresponding to the radius of the inker roller 9, and spaced therefrom, in operation, by a gap A of between about 0.1 to 3 mm width. An elastic sealing material can be applied to the surfaces 11, placed in engagement with the inker roller 9; alternatively, the side walls 3 or the entire unit can be so constructed that the side walls or the unit are resiliently engaged against the inker roller 9.

An excess ink run-off directing shield 12 is located at the outside of the side wall 3. This shield directs ink escaping through the gap A or through worn locations on the surface 11 to an ink collecting trough, not shown, and well known in the chambered inker field.

The inker shown in FIG. 1 is of the type used, for example, with offset printing machines.

Figure 3:
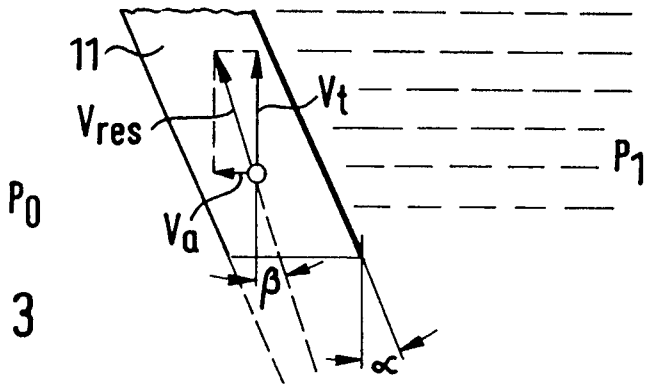
FIG. 3 is a greatly enlarged fragmentary view of the region within the circle III of FIG. 2.

In accordance with a feature of the invention, the forward side wall region 10 of each one of the side walls 3, and hence the curved surface 11, is inclined outwardly—with respect to a plane transverse to the axis of rotation of the roller 9. The run-on position B of the side wall 10, hence, is closer to the center line of the roller 9 than the run-off position C. These positions are shown in FIG. 1 at the engagement points of the doctor blades 5, 4, respectively. The inclination extends at the inner side of the side wall 3 over its entire length or the entire side wall 3 can be placed at an inclination. In accordance with a feature of the invention, and with reference to FIG. 3, a pressure $P_1$ will arise within the chamber 1, due to the liquid ink therein, which pressure is higher than the ambient or outside air pressure $P_0$. Consequently, a component of movement of ink between the surface 11 and the roller 9 will occur which has an outwardly directed speed vector $V_a$. Due to rotation of the roller 9 in the direction of the arrow a, when the inker and the printing machine are in operation, a further movement component $V_t$ will be present in the ink within the chamber. The two vectors will form a resulting speed vector $V_{res}$. The inclination of the region 10 and of the surface 11 to the outside by the angle $\alpha$ is now so selected that this angle $\alpha$ is at least the same or preferably larger than the angle $\beta$ between the vectors $V_{res}$ and $V_t$. Since the movement angle $\beta$ is smaller, or at least the same and not greater than the angle $\alpha$, ink will not be moved outwardly. Particularly, if the angle $\alpha$ is selected to be larger than the angle $\beta$, the combined vector $V_{res}$ is so directed that any ink which is between the roller 9 and the surface 11 will be drawn back within the upwardly expanding portion of the inner space of the base body 1 of the inker.

Various changes and modifications may be made within the scope of the inventive concept; the invention is not restricted to a chambered doctor blade unit as illustrated in FIG. 1, but may be used with fluid application units used in film and ductor and oscillator roller systems as well.

I claim:

1. Fluid application system in combination with a roller or cylinder (9) which rotates at a predetermined speed, to apply a film of fluid, especially for applying printing ink on a surface of the rotating roller or cylinder (9). having an open box-like structure (2) defining a bottom wall, a top wall, a back wall, and two side walls (3), said side walls extending towards the roller or cylinder and having end surfaces (11) essentially matching the radius of the cylinder or roller, wherein said side walls define, with respect to the direction of rotation of the roller or cylinder (9), a run-on position (B) and a run-off position (C), wherein, in accordance with the invention, at least a portion (10) of at least one of the side walls which is adjacent to and facing the roller or cylinder (9) is outwardly tipped, or inclined, starting from a run-on position (B) and extending to a run-off position (C) of the roller or cylinder (9), at an angle of inclination ($\alpha$) with respect to a plane perpendicular to the roller or cylinder (9), and wherein the angle of inclination ($\alpha$) of said side wall portion (10, 11) is at least as great as the angle ($\beta$) of a resulting vector ($V_{res}$) based on a first vector ($V_a$) representative of the speed of ink flow due to pressure differences between ambient pressure ($P_0$) and fluid pressure ($P_1$) within said box-like structure, and a second vector ($V_t$) representative of the speed of movement of the fluid being carried along within said box-like structure upon rotation of said roller or cylinder (9) at said predetermined speed, wherein said angle ($\beta$) of said resultant vector ($V_{res}$) is the angle between said resultant vector and a plane perpendicular to the axis of rotation of said roller or cylinder 9.

2. The system of claim 1, wherein said fluid comprises printing ink.

3. The system of claim 1, wherein said roller or cylinder (9) comprises an anilox roller, and said fluid comprises printing ink.

* * * * *